US010220326B2

(12) United States Patent
Anderson

(10) Patent No.: US 10,220,326 B2
(45) Date of Patent: Mar. 5, 2019

(54) PROJECTIONS THAT RESPOND TO MODEL BUILDING

(71) Applicant: Intel Corporation, Santa Clara, CA (US)

(72) Inventor: Glen J. Anderson, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 102 days.

(21) Appl. No.: 15/294,884

(22) Filed: Oct. 17, 2016

(65) Prior Publication Data

US 2018/0085682 A1 Mar. 29, 2018

Related U.S. Application Data

(63) Continuation-in-part of application No. 15/280,141, filed on Sep. 29, 2016, now abandoned.

(51) Int. Cl.

| | |
|---|---|
| ***A63H 33/42*** | (2006.01) |
| ***A63H 33/22*** | (2006.01) |
| ***A63H 33/26*** | (2006.01) |

(52) U.S. Cl.

CPC ..... *A63H 33/22* (2013.01); *A63H 33/26* (2013.01); *A63H 33/42* (2013.01)

(58) Field of Classification Search

CPC ..... G06F 3/0304; A63F 13/213; A63F 13/25; A63F 2009/246

See application file for complete search history.

(56) References Cited

U.S. PATENT DOCUMENTS

| | | | | |
|---|---|---|---|---|
| 8,839,134 | B2 | 9/2014 | Anderson et al. | |
| 2011/0207504 | A1 | 8/2011 | Anderson et al. | |
| 2014/0327610 | A1* | 11/2014 | Athavale | G06F 3/011 345/156 |
| 2016/0008718 | A1* | 1/2016 | Schaerer | A63F 13/213 463/34 |
| 2016/0225137 | A1* | 8/2016 | Horovitz | A63F 13/65 |
| 2017/0304732 | A1* | 10/2017 | Velic | G06K 9/00201 |

OTHER PUBLICATIONS

"BMW's Augmented Reality Glasses—YouTube", youtube.com/watch?v=Y5ywMb6SeGc, Sep. 3, 2009, 3 pages.

* cited by examiner

*Primary Examiner* — David L Lewis
*Assistant Examiner* — Robert Mosser
(74) *Attorney, Agent, or Firm* — Jordan IP Law, LLC

(57) ABSTRACT

An interactive play system may include at least one projector, at least one toy model assembly and a computing device communicatively coupled to the at least one projector and the at least one assembly structure. The computing device may include a model database to store information about one or more toy model assemblies, an assembly progress detector to determine a current state of the at least one toy model assembly in accordance with information derived from the at least one toy model assembly and the information stored in the model database, a projection content database to store information about content to be projected, and an assembly-projection coordinator to selectively provide an image to be projected to the at least one projector based on the determined current state of the at least one toy model assembly and corresponding content retrieved from the projection content database. Other embodiments are disclosed and claimed.

3 Claims, 5 Drawing Sheets

PROJECTIONS THAT RESPOND TO MODEL BUILDING

CROSS-REFERENCE WITH RELATED APPLICATION

The present application is a Continuation-in-part of U.S. patent application Ser. No. 15/280,141 filed Sep. 29, 2016.

TECHNICAL FIELD

Embodiments generally relate interactive play systems. More particularly, embodiments relate to projections that respond to model building.

BACKGROUND

SMARCKS smart blocks and other smart block toys may respond to assembly events by making sounds and activating lights. LEGO MINDSTORM kits may allow complex configuration and use with simple programming interfaces suitable for younger users, including robots that can be built with the kit. Depending on what blocks are added to the robot as built, the robot may behave in different ways. LEGO FUSION may allow younger users to build models that are photographed and reproduced in a virtual world on a computer screen.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1:
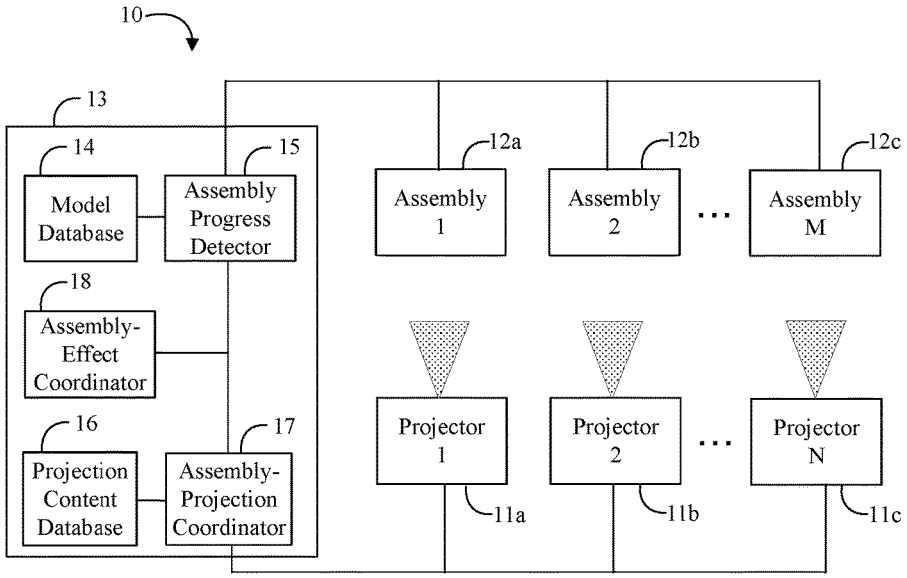
FIG. 1 is a block diagram of an example of an interactive play system according to an embodiment.

Turning now to FIG. 1, an example of an embodiment of interactive play system 10 may include at least one projector 11*a* (or 11*b* or 11 *c*, e.g. projectors 1 through N), at least one toy model assembly 12*a* (or 12*b* or 12*c*, e.g. toy models 1 through M, where N does not necessarily equal M), and a computing device 13 communicatively coupled to the at least one projector 11*a* and the at least one toy model assembly 12*a*. The computing device 13 may include a model database 14 to store information about one or more toy model assemblies, an assembly progress detector 15 to determine a current state of the at least one toy model assembly 12*a* in accordance with information derived from the at least one toy model assembly 12*a* and the information stored in the model database 14, a projection content database 16 to store information about content to be projected, and an assembly-projection coordinator 17 to selectively provide an image to be projected to the at least one projector 11*a* based on the determined current state of the at least one toy model assembly 12*a* and corresponding content retrieved from the projection content database 16. For example, the current state may include one of an in progress state, a sub-assembly completed state, and an assembly completed state. For example, the image to be projected may include one of a static image and a moving image.

In some embodiments of the interactive play system 10, the assembly-projection coordinator 17 may be further to selectively provide the image to be projected based on a determined contextual interpretation of the current state of the at least one toy model assembly 12*a*. The computing device 13 may optionally include an assembly-effect coordinator 18 to identify an effect to accompany the image to be projected, for example based on one or more of the current state of the at least one toy model assembly 12*a* or the determined contextual interpretation. The computing device 13 may further include a database of effects and the system 10 may include one or more effect devices to output the identified effects. The components of the interactive play system 10 may be communicatively coupled to each other as needed, wired or wirelessly, either directly or by a bus or set of busses.

The position of the projectors 11*a*, 11*b*, and 11*c* relative to the toy model assemblies 12*a*, 12*b*, and 12*c* are for illustration purposes only. Projector 11*a* does not necessarily project onto toy model assembly 12*a*. Non-limiting examples of suitable projectors include front, rear, and overhead projectors. Non-limiting examples of suitable projector technology include conventional lighting technology (e.g. high intensity discharge (HID) lights) projectors, LED lighting projectors, nano-projectors, pico-projectors, and laser projectors.

For example, each of the above computing device 13, model database 14, assembly progress detector 15, projection content database 16, assembly-projection coordinator 17, and assembly-effect coordinator 18 may be implemented in hardware, software, or any combination thereof. For example, hardware implementations may include configurable logic such as, for example, programmable logic arrays (PLAs), field programmable gate arrays (FPGAs), complex programmable logic devices (CPLDs), or in fixed-functionality logic hardware using circuit technology such as, for example, application specific integrated circuit (ASIC), complementary metal oxide semiconductor (CMOS) or transistor-transistor logic (TTL) technology, or any combination thereof. Alternatively, or additionally, these components may be implemented in one or more modules as a set of logic instructions stored in a machine- or computer-readable storage medium such as random access memory (RAM), read only memory (ROM), programmable ROM (PROM), firmware, flash memory, etc., to be executed by a processor or computing device. For example, computer program code to carry out the operations of the components may be written in any combination of one or more operating system applicable/appropriate programming languages, including an object oriented programming language such as JAVA, SMALLTALK, C++ or the like and conventional procedural programming languages, such as the "C" programming language or similar programming languages.

Figure 2:
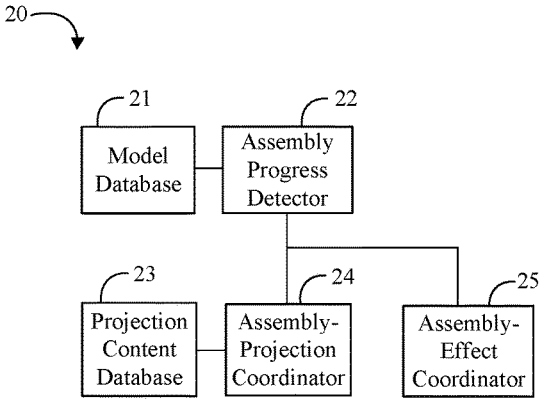
FIG. 2 is a block diagram of an example of an assembly monitoring apparatus according to an embodiment.
Figure 3A:
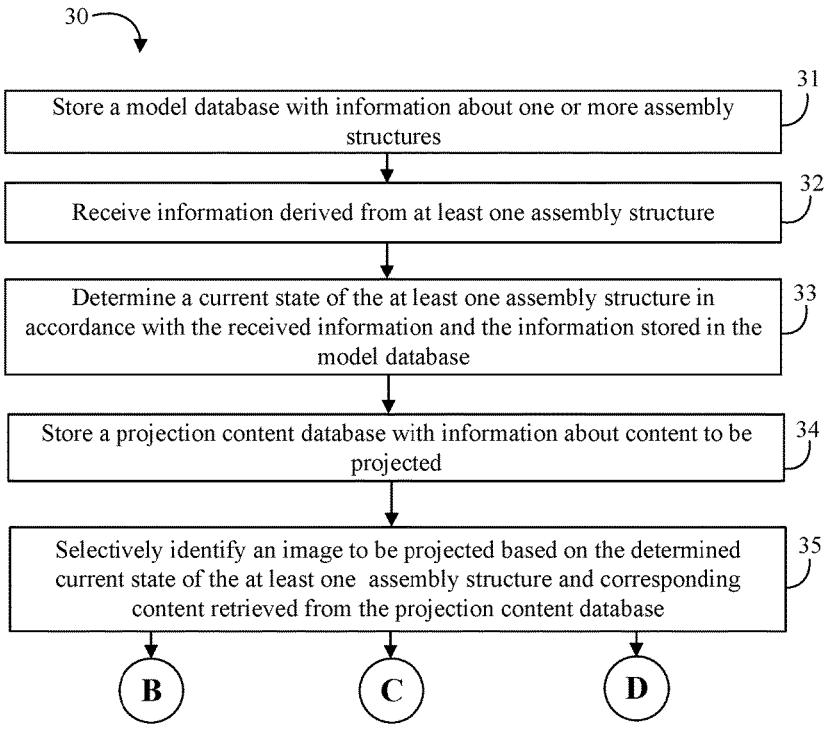
FIGS. 3A to 3D are flowcharts of an example of a method of monitoring an assembly according to an embodiment.
Figure 3B:
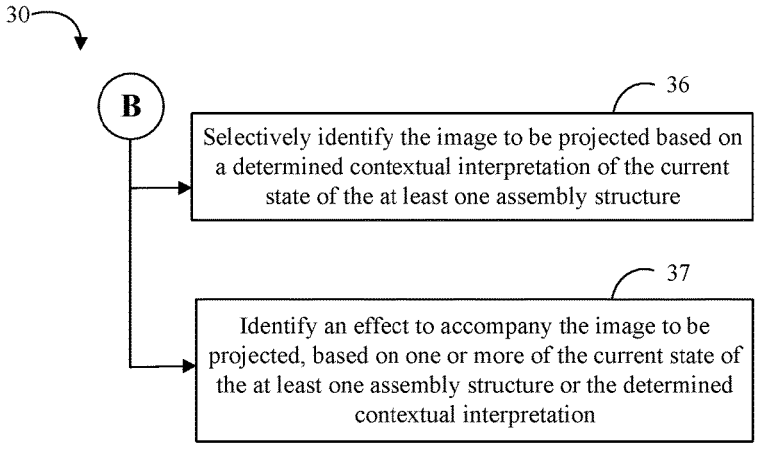
Figure 3C:
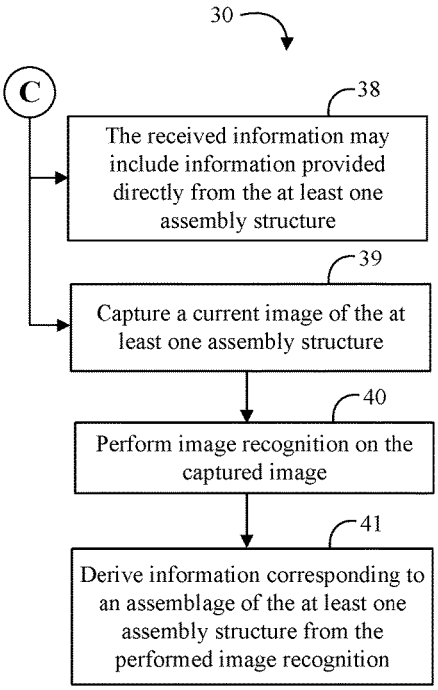
Figure 3D:
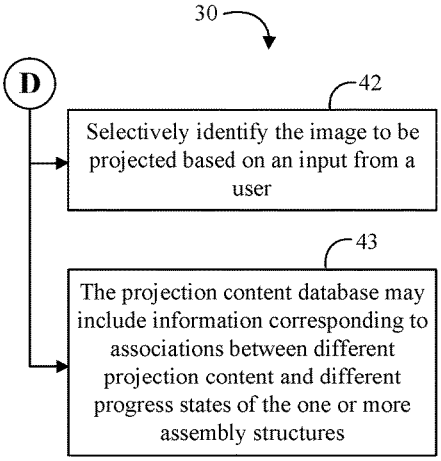

Turning now to FIG. 2, an assembly monitor apparatus 20 may include a model database 21 to store information about one or more assembly structures, an assembly progress detector 22 to determine a current state of at least one assembly structure in accordance with information derived from the at least one assembly structure and the information stored in the model database 21, a projection content database 23 to store information about content to be projected, and an assembly-projection coordinator 24 to selectively identify an image to be projected based on the determined current state of the at least one assembly structure and corresponding content retrieved from the projection content database 23.

For example, the image to be projected may include one of a static image and a moving image. For example, the current state may include one of an in progress state, a sub-assembly completed state, and an assembly completed state. For example, one identified image may be projected after a period of time if the assembly remains in an in progress state (e.g. to encourage free play or continued persistence in completing the assembly or part of the assembly). For example, an image to be projected based a current state of an in progress state may be motivational or may provide a hint for a next step. For example, another identified image may be projected when a sub-assembly is completed and yet another image may be identified when the entire assembly is completed.

In some embodiments of the assembly monitor apparatus 20, the assembly-projection coordinator 24 may be further to selectively identify the image to be projected based on a determined contextual interpretation of the current state of the at least one assembly structure (e.g. in addition to the progress of the assembly). The assembly monitor apparatus 20 may optionally further include an assembly-effect coordinator 25 to identify an effect to accompany the image to be projected, based on one or more of the current state of the at least one assembly structure or the determined contextual interpretation. Non-limiting examples of suitable effects include sound effects, odor effects, haptic effects, steam effects (e.g. fog effects), and other sensory effects.

In some embodiments of the apparatus 20, the information derived from the at least one assembly structure may include information provided directly from the at least one assembly structure. For example, the assembly progress detector 22 may be further to receive information directly from smart blocks that may communicate different stages of assembly. For example, an assembled model may wirelessly report its configuration to the assembly monitor apparatus 20. In addition, or alternatively, in some embodiments of the apparatus 20 the information derived from the at least one assembly structure may include information provided by an image recognition device. For example, a machine vision device may track model assembly. In addition, or alternatively, two dimensional (2D), three dimensional (3D), or depth cameras, for example, may capture image and/or depth information and provide that information to an image analyzer which may communicate object information from the captured image of the at least one assembly structure.

For example, in some embodiments of the apparatus 20 the assembly-projection coordinator 24 may be further to selectively identify the image to be projected in response to an input from a user. In some embodiments of the assembly monitor apparatus 20, the projection content database 23 may include information corresponding to associations between different projection content and different progress states of the one or more assembly structures. For example, various rules may be applied to determine what content is selected to project depending on what stage of assembly is recognized for the at least one assembly structure (as will be explained in more detail below).

Although some embodiments are primarily directed at toys and young user play, other embodiments of assembly structure may be more adult oriented such as furniture or other do-it-yourself (DIY) type assemblies. For example, projections not related to the assembly instructions may advantageously make the adult oriented assembly task more informative, such as projecting a place where the furniture could be placed. For example, what is projected may be related to a contextual interpretation or meaning of what was instructed. For example, if a contextual interpretation of an assembly structure is determined to be a completed shelf of a bookshelf, the projection may fill the completed shelf with projected books to give an idea of how many books might fit on the shelf. Depending on the assembly, sounds or haptic effects may be output with the projection.

For example, each of the above model database 21, assembly progress detector 22, projection content database 23, assembly-projection coordinator 24, and assembly-effect coordinator 25 may be implemented in hardware, software, or any combination thereof. For example, hardware implementations may include configurable logic such as, for example, PLAs, FPGAs, CPLDs, or in fixed-functionality logic hardware using circuit technology such as, for example, ASIC, CMOS or TTL technology, or any combination thereof. Alternatively or additionally, these components may be implemented in one or more modules as a set of logic instructions stored in a machine- or computer-readable storage medium such as RAM, ROM, PROM, firmware, flash memory, etc., to be executed by a processor or computing device. For example, computer program code to carry out the operations of the components may be written in any combination of one or more operating system applicable/appropriate programming languages, including an object oriented programming language such as JAVA, SMALLTALK, C++ or the like and conventional procedural programming languages, such as the "C" programming language or similar programming languages.

Turning now to FIGS. 3A to 3D, a method 30 of monitoring an assembly may include storing a model database with information about one or more assembly structures at block 31, receiving information derived from at least one assembly structure at block 32, determining a current state of the at least one assembly structure in accordance with the received information and the information stored in the model database at block 33, storing a projection content database with information about content to be projected at block 34, and selectively identifying an image to be projected based on the determined current state of the at least one assembly structure and corresponding content retrieved from the projection content database at block 35. For example, the current state may include one of an in progress state, a sub-assembly completed state, and an assembly completed state. For example, the image to be projected may include one of a static image and a moving image.

The method 30 may further include selectively identifying the image to be projected based on a determined contextual interpretation of the current state of the at least one assembly structure at block 36, and/or identifying an effect to accompany the image to be projected, based on one or more of the current state of the at least one assembly structure or the determined contextual interpretation at block 37.

In some embodiments of the method 30, the received information may include information provided directly from the at least one assembly structure at block 38. In addition, or alternatively, some embodiments of the method 30 may further include capturing a current image of the at least one assembly structure at block 39, performing image recognition on the captured image at block 40, and deriving information corresponding to an assemblage of the at least one assembly structure from the performed image recognition at block 41.

For example, in some embodiments of the method 30 selectively identifying the image to be projected may further include selectively identifying the image to be projected based on an input from a user at block 42. For example, the projection content database may include information corresponding to associations between different projection content and different progress states of the one or more assembly structures at block 43. For example, some embodiments of the method 30 may further include projecting the identified image.

The method 30 may generally be implemented in an apparatus such as, for example, the interactive play system 10 (see FIG. 1) or the assembly monitor apparatus 20 (see FIG. 2), already discussed. More particularly, the method 30 may be implemented in one or more modules as a set of logic instructions stored in a machine- or computer-readable storage medium such as RAM, ROM, PROM, firmware, flash memory, etc., in configurable logic such as, for example, PLAs, FPGAs, CPLDs, in fixed-functionality logic hardware using circuit technology such as, for example, ASIC, CMOS or TTL technology, or any combination thereof. For example, computer program code to carry out operations shown in method 30 may be written in any combination of one or more operating system applicable/appropriate programming languages, including an object oriented programming language such as JAVA, SMALLTALK, C++ or the like and conventional procedural programming languages, such as the "C" programming language or similar programming languages.

For example, an embodiment may include at least one computer readable storage medium comprising a set of instructions, which when executed by a computing device, cause the computing device to store a model database with information about one or more assembly structures, receive information derived from at least one assembly structure, determine a current state of the at least one assembly structure in accordance with the received information and the information stored in the model database, store a projection content database with information about content to be projected, and selectively identify an image to be projected based on the determined current state of the at least one assembly structure and corresponding content retrieved from the projection content database. For example, the current state may include one of an in progress state, a sub-assembly completed state, and an assembly completed state. For example, the image to be projected may include one of a static image and a moving image.

The at least one computer readable storage medium may include a further set of instructions, which when executed by the computing device, cause the computing device to selectively identify the image to be projected based on a determined contextual interpretation of the current state of the at least one assembly structure. The at least one computer readable storage medium may include a further set of instructions, which when executed by the computing device, cause the computing device to identify an effect to accompany the image to be projected, based on one or more of the current state of the at least one assembly structure or the determined contextual interpretation.

In some embodiments the system may interpret the context or meaning of the model that is constructed, reacting differently to what is constructed. For example, if the system recognizes that the user has built a road, the system may project cars driving on the road. If the system recognizes that the user has built a parking structure, the system may project parked cars in rows on the parking structure. If the system recognizes that the user has built an airplane, the system may project a runway around it and emit a soundtrack of airport noise, such as other airplanes taking off. If the user constructs a model of a stove, the system may project campfire smoke and emit a simulated food smell. Odor output devices are well known. Depending on the assembled item, the system may create a projection accompanied by any other output or sensory effect, including sound, odor, steam, and vibration. Machine-vision recognition of the assembly may also be used in contextual interpretation. For example, the system may recognize an assembly of blocks as a car, which suggests the context of a road, which the system may then projected near the car. If a recognized object is rapidly disassembled, the contextual interpretation could be an explosion, in which case an explosion may be projected on the model pieces.

The received information may include information provided directly from the at least one assembly structure. In some embodiments, the at least one computer readable storage medium may include a further set of instructions, which when executed by a computing device, cause the computing device to capture a current image of the at least one assembly structure, perform image recognition on the captured image, and derive information corresponding to an assemblage of the at least one assembly structure from the performed image recognition. In some embodiments, the at least one computer readable storage medium may include a further set of instructions, which when executed by a computing device, cause the computing device to selectively identify an image to be projected based on an input from a user. For example, the projection content database may include information corresponding to associations between different projection content and different progress states of the one or more assembly structures.

Advantageously, embodiments of a system described herein may respond with projected images as the system detects the completion of models or parts of models. For example, in some embodiments the detection of the model assembly progress may be done through detection of hardware connections (e.g. smart blocks) or through machine-vision recognition of the assembly. For example, embodiments of the projections may be static images and video to simulate moving objects.

Figure 4:
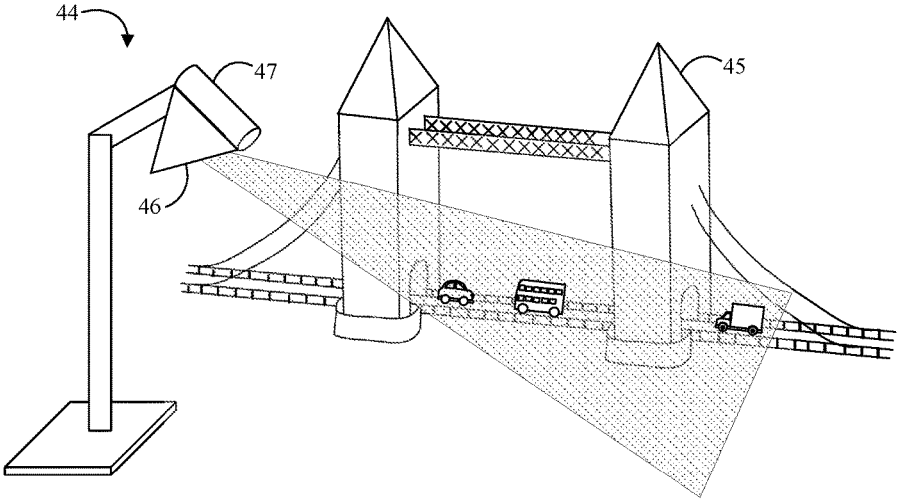
FIG. 4 is a partial perspective view of an example of an interactive play system according to an embodiment.

Turning now to FIG. 4, an example may include a child completing a bridge model 45 (e.g. using LEGO bricks), with such completion being observed or detected by an embodiment of an interactive play system and thereafter causing an overhead projection device 44 to display road marks, guard rails, and/or noisy traffic on the completed bridge model 45. For example, the projection device 44 may include a projector 46 and camera 47 mounted on the projector 46 to capture image information of the assembly progress and provide the captured information to an assembly progress detector of the interactive play system. The position of the projection device 44 relative to the bridge model 45 is for illustration purposes only. For example, an overhead projector may be mounted on a ceiling of room and provide a large projection spread to cover a corresponding large play area. In addition to or alternatively, two or more projection devices may provide overlapping coverage of a play area and may cooperate to simulate continuous movement of images from one projection coverage area to another projection coverage area.

In some embodiments, the bridge model 45 may be assembled with a number of smart blocks and a base block. For example, the smart blocks may include the top portion of one of the towers, a top, mid or bottom section of the tower, a suspension cable, the top span, the main span and so forth. For the illustrated example embodiment, the base block may be the base of one of the towers. In alternate embodiments, the base block may be any block of the bridge model 45. Each of the smart blocks may include a body having features that allow the smart block to be mated with one or more of other smart blocks to form the bridge model 45. Further, in embodiments, each of the smart blocks may include a communication interface (not shown) to communicate to the base block, directly or via another smart block, of its inclusion in the bridge model 45. Additionally, the communication interface of each smart block may also facilitate communication of the configuration, shape and/or size of the smart block. Similarly, the base block may include a body having features that allow the base block to be mated with one or more of other smart blocks to become a member of the bridge model 45. Further, the base block may include a communication interface to receive communications from the smart blocks. In embodiments, the communication interface of a smart block and/or the communication interface of the base block may be configured to support wired serial communication or wireless communication with the interactive play systems and/or assembly monitor apparatuses described herein.

In embodiments, in lieu of the smart blocks having communication interfaces to communicate their inclusion into the bridge model, or in addition thereto, the base block or other component of the interactive play system may further include an object recognizer configured to receive one or more images (e.g. via one of the communication interface) and analyze the one or more images to determine the state of the bridge model 45, and/or the state of the bridge model 45 in conjunction to related neighboring block structures (such as, a model of a building). In embodiments, the one or more images may be provided by an independent 2D or 3D camera (not shown), or a 2D or 3D camera incorporated within one of the block structures or another proximate toy or play device.

An example method for objection recognition may include partitioning a received image into a number of regions, analyzing each region to recognize and identify objects within the region, and repeating as many times as necessary to have each region analyzed, and the objects therein identified. Further, in the performance of each iteration for a region, the process itself may be recursively performed to have the region further sub-divided, and the sub-regions iteratively analyzed to recognize and identify objects within the sub-regions. The process may be recursively performed for any number of times, depending on computing resource available and/or accuracy desired. On completion of analysis of all the regions/sub-regions, the process may end. In some embodiments, the smart blocks may be provided with visual markers to facilitate their recognition. The visual markers may be or may not be humanly visible and/or comprehensible. As part of the object recognition process, the configuration, shape and/or dimensions of the smart blocks (including dimensions between one or more smart blocks, such as tunnels and/or the space between inter-spans formed by the smart blocks) may be identified.

An example data structure suitable for use to represent a state of a block structure, according to various embodiments, may be a tree structure having a number of nodes connected by branches. In particular, the example data structure may include a root node to represent the base block. One or more other nodes representing other smart blocks directly connected the base block may be linked to the root node. Similarly, other nodes representing still other smart blocks directly connected to the smart blocks may be respectively linked to those nodes, and so forth. In embodiments, information about the smart nodes, such as configuration, shape, size and so forth, may be stored at the respective nodes. Thus, by traversing the example data structure, a computing device may determine a current state of the represented block structure. Additionally, if the base block is provided with information about related or proximately disposed adjacent block structures, nodes representing the base blocks of these other blocks structures may be linked to the root node. According, for these embodiments, likewise, by traversing the example data structure, a computing device may further determine the current states of the represented neighboring block structures.

Figure 5A:
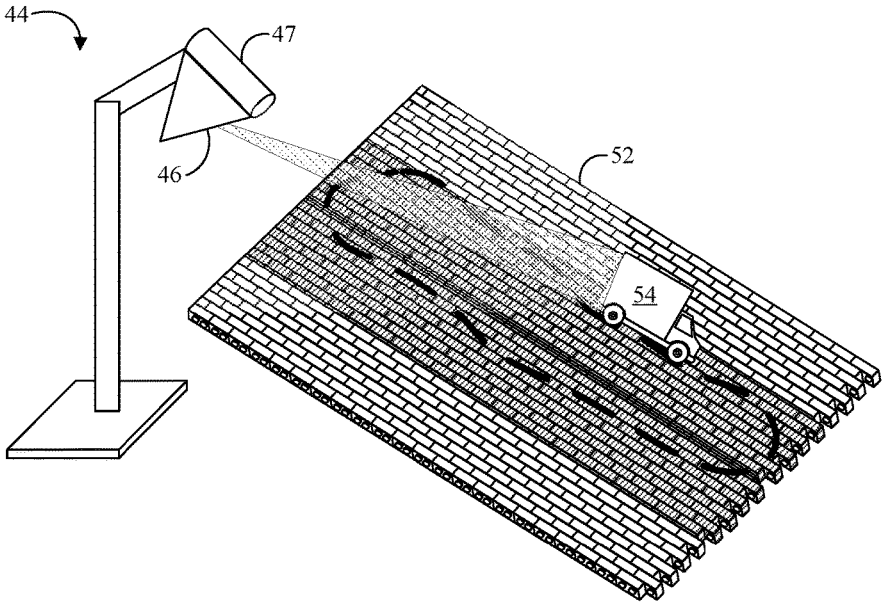
FIGS. 5A and 5B are partial perspective views of another example of an interactive play system according to an embodiment.
Figure 5B:
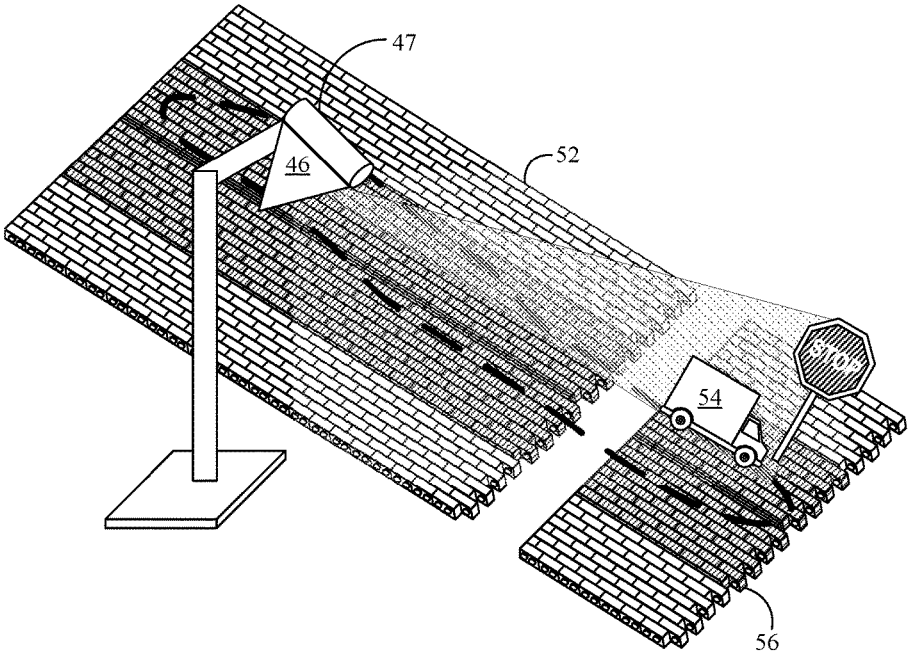

Turning now to FIGS. 5A and 5B, embodiments of the detection process may be interactive with the model being built. For example, as the child builds a road 52, a moving truck 54 may be projected but only go as far as the end of the completed section before turning around (e.g. following the dashed path in FIG. 5A). After the next section 56 of road is added (e.g. see FIG. 5B), the projected truck 54 may travel further or make some other action, including sound or haptic effects, related to what the interactive play system recognizes. For example, the projected truck 54 may come to a stop at a projected stop sign and beep its horn before continuing along the dashed path.

In some embodiments, assembled models may be previously known to the system, and would thus be matched to digital representations of the models. In addition, or alternatively, the system may interpret assemblies (e.g. through shape recognition) as appearing like known objects and react with appropriate images automatically.

In addition to or alternative to projection assembly instructions, some embodiments may advantageously provide projections that respond to physical connections of models. For example, some embodiment may advantageously provide interactive projected content with objects and characters not related to assembly instructions. An interactive play system in accordance with some embodiments may advantageously include other modalities such as speech or touch input so that the user may make indications of desired system behaviors (e.g., the user could say, "I want a car instead of the truck"). The user may also indicate a direction or sound for the projection. In addition to projections, some embodiments may output sounds or haptic vibrations along with projections. As noted above, some embodiments may have more than one projector.

Figure 6:
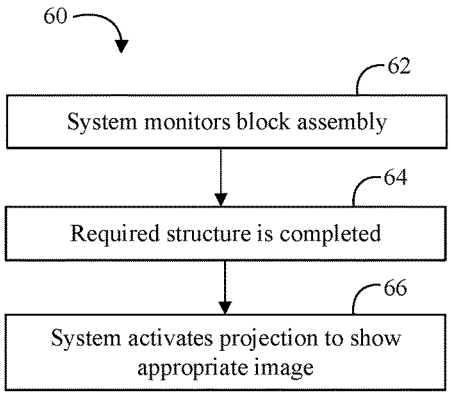
FIG. 6 is a flowchart of an example of a method of operating an interactive play system according to an embodiment.

Turning now to FIG. 6, a method 60 of operating an interactive play system may include the interactive play system monitoring a block assembly at block 62, determining that a required structure is completed at block 64, and activating a projection to show an appropriate image at block 66 (optionally, a sensory effect may also be activated).

Figure 7:
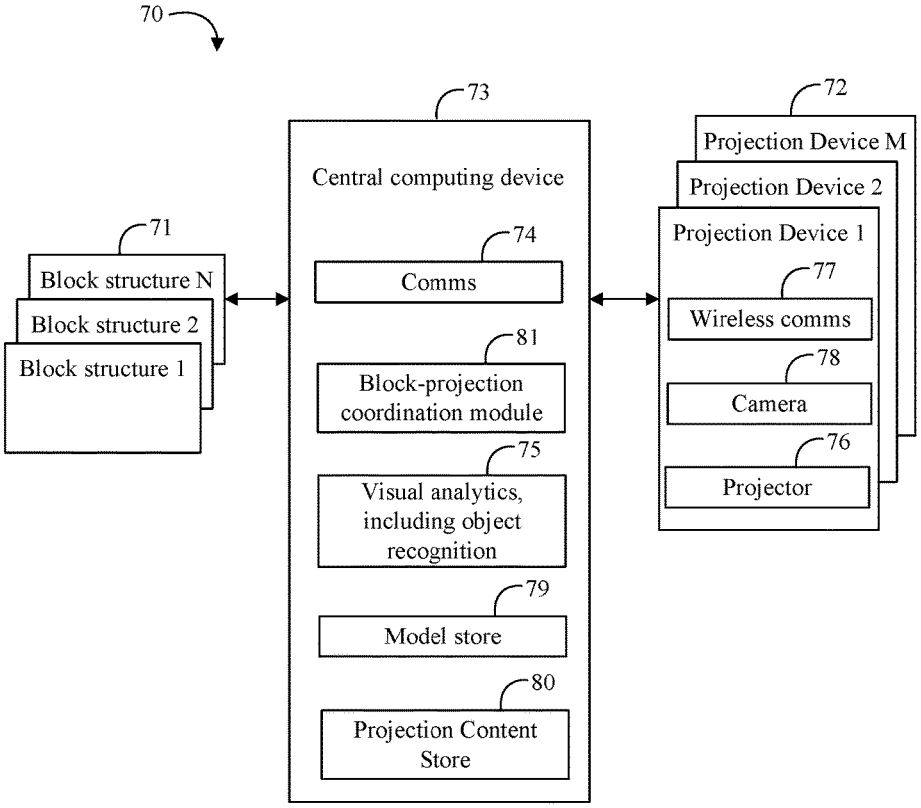
FIG. 7 is a block diagram of another example of an interactive play system according to an embodiment.

Turning now to FIG. 7, an interactive play system 70 may include a set of block structures 71 (e.g. block structures 1 through N). The interactive play system 70 may further include a set of projection devices 72 (e.g. projectors 1 through M, where N does not necessarily equal M). The interactive play system 70 may further include a central computing device 73 that may be communicatively coupled to the block structures 71 and the projection devices 72.

For example, the central computing device 73 may include a communication interface 74 that can communicate over wired or wireless interfaces with the block structures 71 and the projection devices 72. Non-limiting examples of suitable wired interfaces include Universal Serial Bus (USB). Non-limiting examples of suitable wireless interfaces include WiFi, Bluetooth, Bluetooth Low Energy, ANT, ANT+, ZigBee, Radio Frequency Identification (RFID), and Near Field Communication (NFC). Other wired or wireless standards or proprietary wired or wireless interfaces may also be used.

The central computing device 73 may further include a visual analytics interface 75, including an image/object recognition module that uses 2D/3D camera input to identify the structure, its characteristics, and elements. For example, the projection devices 72 may be equipped with a projector 76, a wireless communication interface 77, and a camera 78 (or cameras, e.g. 2D cameras, 3D cameras, and/or depth cameras) that enable object recognition through the visual analytics interface 75 that can be used to determine data corresponding to the type of the block structures 71 and the state of the block structures 71 build process, and its characteristics, e.g., pieces of a road added. Some block structures 71 may include markers that can be recognized by the camera and facilitate identification process. The markers may or may not be visible by human eyes.

For example, the block structures 71 may additionally or alternatively include smart block assembly structures that can be automatically determined (shape, size, and configuration). For example, contacts between the smart blocks may allow reporting of block connections, which allows direct software-based determination of assembled shapes without image analysis. The interactive play system 70 may further include a model store 79 of 3D models and shapes to allow comparison for recognition of models and other objects.

Advantageously, embodiments of the interactive play system 70 may further include a projection content store 80 to store a database of projection content with rules for when to display respective projections. For example, projected cars for model roads, projected signs for model roads, projected fire for a model building, projected paths that match the length of model road, etc. Advantageously, embodiments of the interactive play system 70 may further include a block-projection coordination module 81 that controls the timing and type of projections based on, among other things, the projection content store 80. The block-projection coordination module 81 may also control the timing and type of projections based on a meaning or contextual interpretation of the block structures. For example, the visual analytics interface 75 may operate independently or jointly with the block-projection coordination module 81.

In some embodiments of the interactive play system 70, the blocks 71 may be assembled on a base that receives data on connections and determines configurations, while the projection devices 72 may be wirelessly connected. The block base may have a complete computing system (e.g. the computing device 73) to allow analysis of block connections as well as analysis of sensor data from one or more cameras (e.g. cameras 78), or these components may be located in another part of the system, and may be connected either through a local network or a cloud-based connection. For example, image capture may be performed locally, while the model store 79 and visual analytics interface 75 may be on the cloud. Likewise, the projection content store 80 may be stored on the cloud. The system 70 may optionally include sensory effect devices and a block-effect coordinator to output effects along with the projections (e.g. identifying suitable effects from an appropriate database of effects).

Additional Notes and Examples

Example 1 may include an interactive play system, comprising at least one projector, at least one toy model assembly, a computing device communicatively coupled to the at least one projector and the at least one toy model assembly, wherein the computing device includes a model database to store information about one or more toy model assemblies, an assembly progress detector to determine a current state of the at least one toy model assembly in accordance with information derived from the at least one toy model assembly and the information stored in the model database, a projection content database to store information about content to be projected, and an assembly-projection coordinator to selectively provide an image to be projected to the at least one projector based on the determined current state of the at least one toy model assembly and corresponding content retrieved from the projection content database.

Example 2 may include the interactive play system of Example 1, wherein the assembly-projection coordinator is further to selectively provide the image to be projected based on a determined contextual interpretation of the current state of the at least one toy model assembly.

Example 3 may include the interactive play system of Example 2, wherein the computing device further comprises an assembly-effect coordinator to identify an effect to accompany the image to be projected, based on one or more of the current state of the at least one toy model assembly or the determined contextual interpretation.

Example 4 may include an assembly monitor apparatus, comprising a model database to store information about one or more assembly structures, an assembly progress detector to determine a current state of at least one assembly structure in accordance with information derived from the at least one assembly structure and the information stored in the model database, a projection content database to store information about content to be projected, and an assembly-projection coordinator to selectively identify an image to be projected based on the determined current state of the at least one assembly structure and corresponding content retrieved from the projection content database.

Example 5 may include the assembly monitor apparatus of Example 4, wherein the assembly-projection coordinator is further to selectively identify the image to be projected based on a determined contextual interpretation of the current state of the at least one assembly structure.

Example 6 may include the assembly monitor apparatus of Example 5, further comprising an assembly-effect coordinator to identify an effect to accompany the image to be projected, based on one or more of the current state of the at least one assembly structure or the determined contextual interpretation.

Example 7 may include the assembly monitor apparatus of any of Examples 4 to 6, wherein the information derived from the at least one assembly structure includes information provided directly from the at least one assembly structure.

Example 8 may include the assembly monitor apparatus of any of Examples 4 to 6, wherein the information derived from the at least one assembly structure includes information provided by an image recognition device.

Example 9 may include the assembly monitor apparatus of any of Examples 4 to 6, wherein the assembly-projection coordinator is further to selectively identify the image to be projected in response to an input from a user.

Example 10 may include the assembly monitor apparatus of any of Examples 4 to 6, wherein the projection content database includes information corresponding to associations between different projection content and different progress states of the one or more assembly structures.

Example 11 may include a method of monitoring an assembly, comprising storing a model database with information about one or more assembly structures, receiving information derived from at least one assembly structure, determining a current state of the at least one assembly structure in accordance with the received information and the information stored in the model database, storing a projection content database with information about content to be projected, and selectively identifying an image to be projected based on the determined current state of the at least one assembly structure and corresponding content retrieved from the projection content database.

Example 12 may include the method of Example 11, further comprising selectively identifying the image to be projected based on a determined contextual interpretation of the current state of the at least one assembly structure.

Example 13 may include the method of Example 12, further comprising identifying an effect to accompany the image to be projected, based on one or more of the current state of the at least one assembly structure or the determined contextual interpretation.

Example 14 may include the method of any of Examples 11 to 13, wherein the received information includes information provided directly from the at least one assembly structure.

Example 15 may include the method of any of Examples 11 to 13, further comprising capturing a current image of the at least one assembly structure, performing image recognition on the captured image, and deriving information corresponding to an assemblage of the at least one assembly structure from the performed image recognition.

Example 16 may include the method of any of Examples 11 to 13, wherein selectively identifying the image to be projected further includes selectively identifying the image to be projected based on an input from a user.

Example 17 may include the method of any of Examples 11 to 13, wherein the projection content database includes information corresponding to associations between different projection content and different progress states of the one or more assembly structures.

Example 18 may include at least one computer readable storage medium comprising a set of instructions, which when executed by a computing device, cause the computing device to store a model database with information about one or more assembly structures, receive information derived from at least one assembly structure, determine a current state of the at least one assembly structure in accordance with the received information and the information stored in the model database, store a projection content database with information about content to be projected, and selectively identify an image to be projected based on the determined current state of the at least one assembly structure and corresponding content retrieved from the projection content database.

Example 19 may include the at least one computer readable storage medium of Example 18, comprising a further set of instructions, which when executed by a computing device, cause the computing device to selectively identify the image to be projected based on a determined contextual interpretation of the current state of the at least one assembly structure.

Example 20 may include the at least one computer readable storage medium of Example 19, comprising a further set of instructions, which when executed by a computing device, cause the computing device to identify an effect to accompany the image to be projected, based on one or more of the current state of the at least one assembly structure or the determined contextual interpretation.

Example 21 may include the at least one computer readable storage medium of any of Examples 18 to 20, wherein the received information includes information provided directly from the at least one assembly structure.

Example 22 may include the at least one computer readable storage medium of any of Examples 18 to 20, comprising a further set of instructions, which when executed by a computing device, cause the computing device to capture a current image of the at least one assembly structure, perform image recognition on the captured image, and derive information corresponding to an assemblage of the at least one assembly structure from the performed image recognition.

Example 23 may include the at least one computer readable storage medium of any of Examples 18 to 20, comprising a further set of instructions, which when executed by a computing device, cause the computing device to selectively identify an image to be projected based on an input from a user.

Example 24 may include the at least one computer readable storage medium of any of Examples 18 to 20, wherein the projection content database includes information corresponding to associations between different projection content and different progress states of the one or more assembly structures.

Example 25 may include an assembly monitor apparatus, comprising means for storing a model database with information about one or more assembly structures, means for receiving information derived from at least one assembly structure, means for determining a current state of the at least one assembly structure in accordance with the received information and the information stored in the model database, means for storing a projection content database with information about content to be projected, and means for selectively identifying an image to be projected based on the determined current state of the at least one assembly structure and corresponding content retrieved from the projection content database.

Example 26 may include the assembly monitor apparatus of Example 25, further comprising means for selectively identifying the image to be projected based on a determined contextual interpretation of the current state of the at least one assembly structure.

Example 27 may include the assembly monitor apparatus of Example 26, further comprising means for identifying an effect to accompany the image to be projected, based on one or more of the current state of the at least one assembly structure or the determined contextual interpretation.

Example 28 may include the assembly monitor apparatus of any of Examples 25 to 27, wherein the received information includes information provided directly from the at least one assembly structure.

Example 29 may include the assembly monitor apparatus of any of Examples 25 to 27, further comprising means for capturing a current image of the at least one assembly structure, means for performing image recognition on the captured image, and means for deriving information corresponding to an assemblage of the at least one assembly structure from the performed image recognition.

Example 30 may include the assembly monitor apparatus of any of Examples 25 to 27, wherein the means for selectively identifying the image to be projected further includes means for selectively identifying the image to be projected based on an input from a user.

Example 31 may include the assembly monitor apparatus of any of Examples 25 to 27, wherein the projection content database includes information corresponding to associations between different projection content and different progress states of the one or more assembly structures.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrases "one or more of A, B or C" may mean A; B; C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

I claim:

1. An interactive play system, comprising:

at least one projector;

at least one toy model assembly;

a computing device communicatively coupled to the at least one projector and the at least one toy model assembly, wherein the computing device includes:

a model database to store information about one or more toy model assemblies;

an assembly progress detector to determine a current state of the at least one toy model assembly in accordance with information derived from the at least one toy model assembly and the information stored in the model database;

a projection content database to store information about content to be projected; and an assembly-projection coordinator to selectively provide an image, to be projected onto the at least one toy model assembly, to the at least one projector based on the determined current state of the at least one toy model assembly and corresponding content retrieved from the projection content database.

2. The interactive play system of claim 1, wherein the assembly-projection coordinator is further to selectively provide the image to be projected based on a determined contextual interpretation of the current state of the at least one toy model assembly.

3. The interactive play system of claim 2, wherein the computing device further comprises:

an assembly-effect coordinator to identify an effect to accompany the image to be projected, based on one or more of the current state of the at least one toy model assembly or the determined contextual interpretation.

* * * * *